United States Patent [19]

Harakawa et al.

[11] 4,175,262

[45] Nov. 20, 1979

[54] BUZZER WITH RIGID ELECTRICAL LEADS

[75] Inventors: Mototaka Harakawa; Yoshio Mitumori, both of Shizuoka, Japan

[73] Assignee: Star Seimitsu Kabushiki Kaisha, Japan

[21] Appl. No.: 906,912

[22] Filed: May 17, 1978

[30] Foreign Application Priority Data

May 17, 1977 [JP] Japan ..... 52-56627

[51] Int. Cl.[2] ..... G10K 9/12; G10K 1/00

[52] U.S. Cl. ..... 340/388; 340/384 E; 340/392; 340/396

[58] Field of Search ..... 340/388, 384 E, 392, 340/396

[56] References Cited

U.S. PATENT DOCUMENTS 3,950,744 4/1976 Stephens ..... 340/388

*Primary Examiner*—Harold I. Pitts

*Attorney, Agent, or Firm*—Holman & Stern

[57] ABSTRACT

A buzzer comprises a vibrator unit including a diaphragm which is supported within a housing, and a drive unit including a coil assembly which electromagnetically excites the vibrator unit. The coil assembly includes a bobbin of a non-magnetic and non-conductive material and having flanges at its both axial ends, and a winding disposed on the bobbin. The drive unit is supported by at least one of the flanges and is provided with a plurality of rigid electrical leads which project to the exterior of the housing.

16 Claims, 10 Drawing Figures

FIG. 6
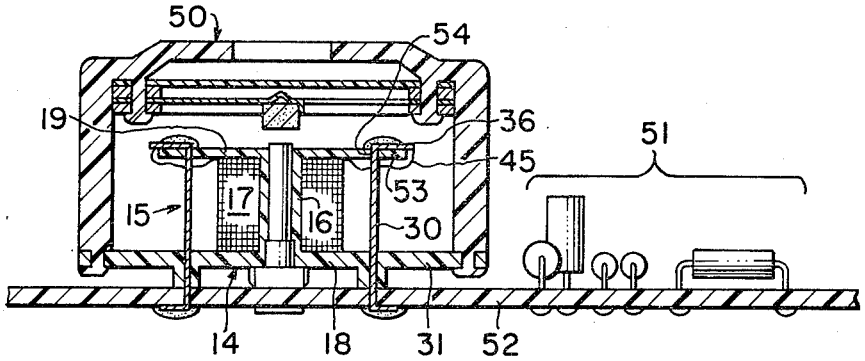
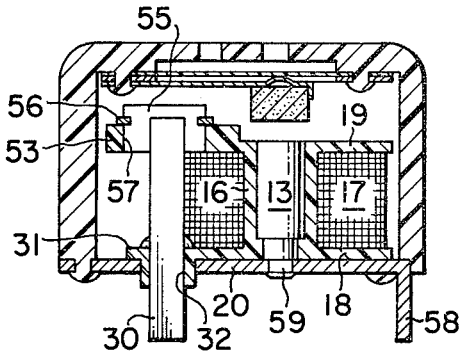
FIG. 7
FIG. 8
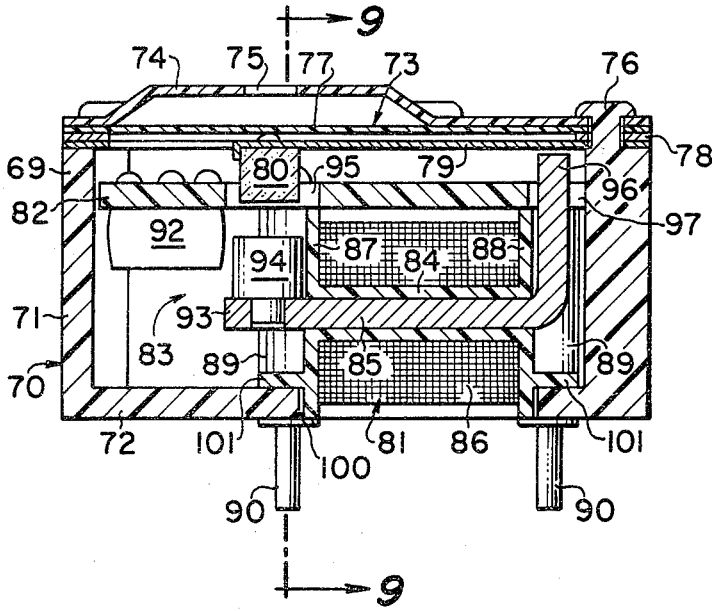

BUZZER WITH RIGID ELECTRICAL LEADS

FIELD OF THE INVENTION

The invention relates to a buzzer including a diaphragm which is excited by an electromagnet for producing an audible signal, and more particularly, to a buzzer including a housing which internally houses the electromagnet and which is provided with a plurality of rigid electrical leads projecting to the outside of the housing, the leads serving to fixedly mount the buzzer on a mounting structure and to connect electrically the electromagnet with an external electrical circuit.

DESCRIPTION OF THE PRIOR ART

A buzzer including an electromagnet can be categorized into two types, namely, one in which an electromagnet magnetically excites a diaphragm formed of a magnetic material directly or an armature mounted on the diaphragm, and another in which a cantilever vibrating arm excited by the electromagnet physically impacts a plastic or metallic diaphragm. A buzzer of the latter type is suitable to produce a greater sound level than the former, but the construction of the electromagnet is substantially the same in either type. It is necessary to induce a regularly varying magnetic field in the magnetic core of the electromagnet. At this end, it is known since old to provide contacts interposed between a coil which excites the core and a power source so that they cooperate with the core to provide an intermittent interaction. However, the recent buzzers employ a pair of coils disposed on the core and which are connected in a transistor oscillation circuit. The electrical components of the oscillator circuit are mounted on a printed circuit board which is received in a housing together with the electromagnet. As known, the printed circuit board can be disposed in a variety of ways within the housing.

The provision of rigid electrical leads is proposed which project out of the housing of the buzzer in order to electrically connect the electromagnetically driven buzzer with an external power source or electrical circuit and to fixedly mount it on a mounting structure.

U.S. Pat. No. 3,950,744 discloses a housing having a bottom which is formed by a plastic base on which a printed circuit board is disposed in superimposed relationship and which is formed with through-holes receiving interconnecting pins. One end of the pins is electrically connected with the circuit on the printed board within the housing while their other end projects out of the plastic base. The yoke of a U-shaped core is interposed between the base and the printed circuit board, and one limb of the core extends upright through the printed circuit board into the housing, with a bobbin-free coil mounted thereon.

U.S. Pat. No. 3,810,149 discloses a housing having a base on which an electromagnet is secured, with a pair of rigid electrical terminals which feed the electromagnet mounted on the opposite side of the base. The individual terminals are mounted on the base by common rivets together with brackets of a conductive material disposed on the base. The terminals are electrically connected with the coil through the rivets and the brackets. Contacts are connected in series between one end of the winding and one of the brackets.

U.S. Pat. No. 3,760,411 discloses a pair of electrical terminals which have their end projecting through a sidewall of a housing to the outside thereof and which are riveted to a shoulder of the housing. The other end of one terminal is elongate and is folded to carry a coil assembly thereon. The winding of the coil assembly is electrically connected between the pair of terminals through a normally closed contact.

It is found that the construction of a buzzer having rigid electrical leads is inapplicable to a buzzer of latest design since the construction or assembly of the buzzer is made inconvenient. Specifically, when electrical components are attached to the printed circuit board by utilizing the known dip soldering technique in the arrangement of U.S. Pat. No. 3,950,744, the end of lead wires of the electrical components project to the opposite side of the board, preventing a proper disposition of the board on the plastic board. In addition, the yoke of the core interposed between the board and the plastic board must be electrically insulated from the board. In the buzzers described in U.S. Pat. Nos. 3,810,149 and 3,760,411, rivets must be used to attach the electrical leads. In addition, there is no suggestion that such construction can be applied to a recent buzzer design which utilizes a printed circuit board located within a housing.

SUMMARY OF THE INVENTION

It is an object of the invention to provide a buzzer which is simple in construction and assembly by providing rigid electrical leads.

The invention is applicable to a board variety of electromagnetically driven buzzers of the type in which a coil assembly including a bobbin is housed within a housing. A buzzer of this type may contain a printed circuit board or an integrated circuit device within the housing together with the coil assembly. However, since each of the electrical leads can be inserted into a corresponding circuit or easily connected with a printed circuit board of an external circuit arrangement, all of the electrical components exclusive of the coil assembly can be removed out of the housing and transferred to the external circuit, thus providing a buzzer of a simple construction.

In accordance with the invention, there is provided a buzzer having rigid electrical leads comprising a housing, a vibrator unit including a diaphragm which is supported within the housing, and a drive unit including a coil assembly which electromagnetically excites the vibrator unit, the coil assembly including a bobbin of a non-magnetic and non-conductive material having flanges at its opposite axial ends and a winding disposed on the bobbin, the drive unit including a plurality of rigid electrical leads which project out of the buzzer and electrical circuit means for connecting the leads with the winding, at least one of the flanges being provided with guide means which support the electrical leads.

It is a feature of the invention to provide rigid electrical leads which are connected with a printed circuit board or integrated circuit device carrying electrical components and which are attached to a coil assembly together with the board or device, thus providing an integral drive unit. In this manner, a buzzer having rigid electrical leads can be simply assembled by merely mounting the drive unit on a housing which is previously provided with a vibrator unit including a diaphragm. In addition, a proper orientation of the buzzer can be maintained over a prolonged period of time without requiring or minimizing an adjustment thereof.

In a preferred embodiment of the invention, the bobbin has an axis which is at right angles to the diaphragm. The bobbin has a pair of upper and lower flanges. The lower flange is placed on the base within the housing while the upper flange extends in parallel spaced relationship with the diaphragm and carries the printed circuit board thereon. The leads pass through through-holes formed in the lower flange to extend axially of the bobbin, with their end which is located within the housing being soldered to a circuit on the circuit board. In a buzzer of this type, the end of the leads is soldered to the circuit simultaneously as the electrical components of a transistor oscillator circuit are soldered to the printed circuit board, and the completed board is mounted on the upper flange of the bobbin of the coil assembly by fitting the leads in the through-holes formed in the lower flange, the resulting drive unit inclusive of the coil assembly and the printed circuit board being mounted on the housing. The mounting of a printed circuit board on a coil bobbin is already disclosed in U.S. Pat. No. 3,974,499 assigned to the common assignee as the present invention. The board is so disposed that the mounting of the electrical components removed from a bobbin region avoids any inconvenience when mounting the board on the bobbin. In a modification, the lower flange of the bobbin may serve as a base of the housing.

When assemblying a flat packaged integrated circuit device having the function of an electronic oscillator circuit into the housing, a frame member of the device can be utilized in place of the electrical leads as termed in the invention. In this instance, the device is directly mounted on the upper flange of the coil bobbin, and the frame member is passed through through-hole formed in their lower flange to extend straight to the exterior.

In another preferred embodiment of the invention, the coil bobbin has an axis which is parallel to the diaphragm. One of the flanges on the bobbin is formed with elongate through-holes, into which the electrical leads are fitted. In a buzzer of this type, a printed circuit board may be mounted so as to extend across the pair of flanges of the bobbin, and the electrical leads are directly connected with the circuit thereon.

Above and other objects, features and advantages of the invention will become apparent from the following description with reference to several embodiments thereof shown in the drawings.

BRIEF DESCRIPTION OF THE DRAWINGS

FIG. 6 is a cross section of another embodiment of the invention;

FIG. 7 is a cross section of a further embodiment of the invention;

FIG. 8 is a cross section of buzzer which is slightly modified from that shown in FIG. 1;

DESCRIPTION OF PREFERRED EMBODIMENTS

Figure 1:
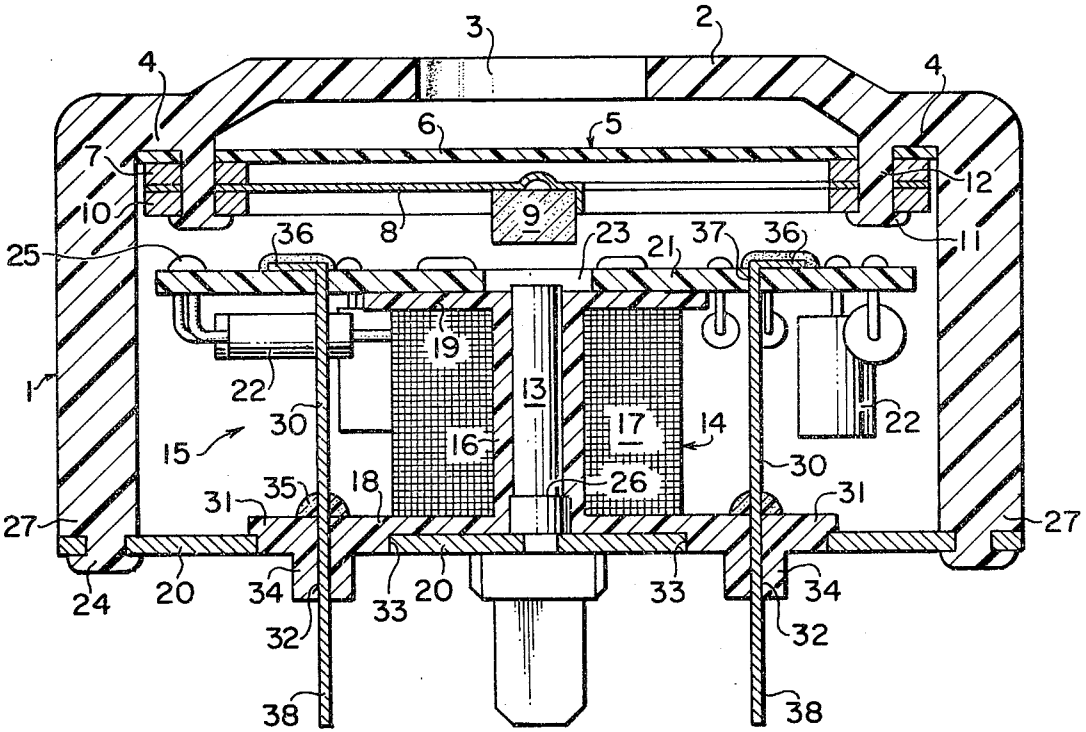
FIG. 1 is a cross section of a buzzer having rigid electrical leads constructed according to the invention.
Figure 2:
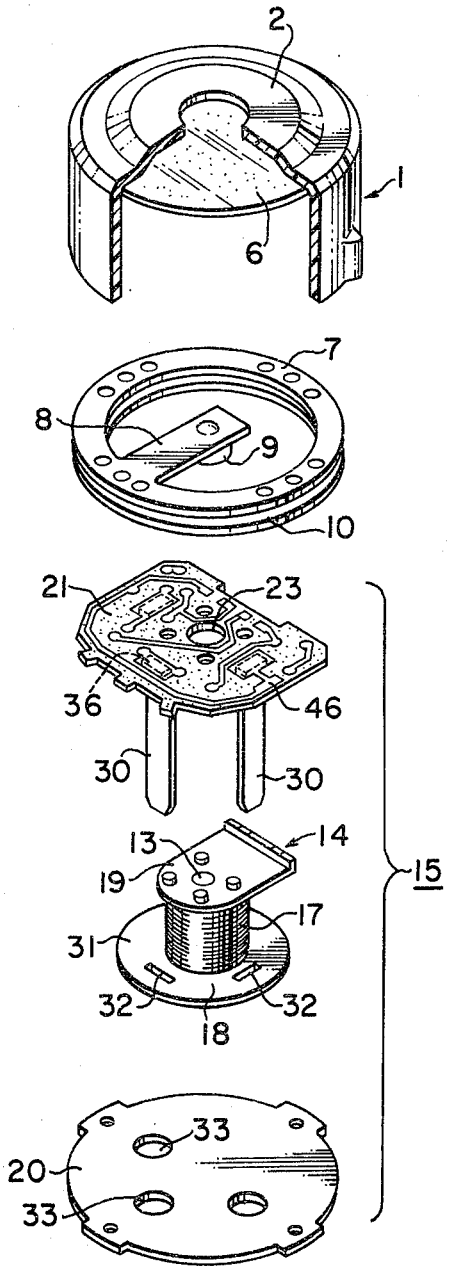
FIG. 2 is an exploded perspective view of the buzzer shown in FIG. 1.

Referring to FIGS. 1 and 2, the buzzer according to the invention includes a cylindrical housing 1 molded from a synthetic resin material. The housing 1 is integrally provided with a top member 2 in which an aperture 3 is formed. The other end 27 of the housing is open. The top member 2 defines a shoulder 4 inside the housing 1 on which a plurality of small cylindrical rivets 12 are integrally formed, these rivets serving to support a vibrator unit 5. The unit 5 comprises a diaphragm 6 formed of a synthetic resin or a metal material and spaced from the top member 2, a spacer ring 7, a cantilever vibrating arm 8 of a magnetic material carrying a striker 9 of a permanent magnet material on its free end which is spaced from the diaphragm by a predetermined gap in static condition, and a support ring 10. The mounting of such vibrator unit 5 within the housing 1 by means of rivets 12 is described in detail in the U.S. Pat. No. 3,974,499 and therefore will not be detailed. However, briefly, the rivets 12 are initially formed as straight solid cylinders. The parts are formed with apertures which fit over these cylinders. After they are fitted on the individual cylinders, the top 11 of the cylinders are swaged under heat and pressure, thus supporting various parts in position. It is to be understood that the construction and the manner of supporting the vibrator unit 5 does not form part of the present invention.

The vibrating arm 8 is excited by a drive unit 15 including a coil assembly 14 which has a magnetic core 13. The assembly 14 comprises a bobbin 16 which surrounds the core 13, and a winding 17 disposed on the bobbin 16. The winding 17 may comprise a pair of control and drive coils connected with an electronic oscillator circuit and which are formed as a bifilar winding. The bobbin 16 is molded from a non-magnetic and non-conductive material such as ABS resin, for example, and has an axis which is perpendicular to the diaphragm 6 of the vibrator unit 5. The bobbin 16 is molded to have a pair of integral flanges 18, 19 at its opposite ends. The drive unit 15 additionally includes a baseplate 20 of a magnetic material which is mounted beneath the lower flange 18, and a printed circuit board 21 mounted on top of the upper flange 19. Electrical components 22 are secured to the board 21 by soldering as shown at 25 so as to form an electronic oscillator circuit which energizes the winding 17 to induce an oscillating magnetic field through the core 13. It will be noted that the board 21 has a greater area than the upper flange 19, and a portion thereof extending beyond the upper flange 19 carries electrical components 22 on its underside. In this manner, it is possible to dispose the board 21 within a limited space between the upper flange 19 and the vibrator unit 5. The board 21 is centrally formed with an opening 23, into which the end of the core 13 extends so as to be located opposite to the striker 9 on the arm 8. The core 23 is coaxial with the bobbin 16, and has a stop 26 which engages the bobbin 16 to hold the core firmly in position. The drive unit 15 is inserted through a bottom opening in the housing 1, and is positioned and mounted in the housing by fixing the baseplate 20 which is mounted on the lower flange 18 by means of a plurality of rivets 24 formed at the bottom end 27 of the housing, generally in the similar manner as the vibrator unit 5 is mounted. The construction and the manner of support of the drive unit 15 is also described in detail in U.S. Pat. No. 3,974,499 and therefore will not be detailed herein. However, it will be appreciated that the drive unit 15 is exactly positioned relative to the vibrator unit 5 within the housing 1.

In accordance with the invention, the drive unit 15 includes a plurality of rigid electrical leads 30 which connect the electronic oscillator circuit on the board 21 with an external power source or other circuit. The leads 30 extend parallel to the axis of the bobbin 16, passing through holes 32 formed in an extension 31 of the lower flange 18. The upper end 36 of the leads passes through a through-hole 37 formed in the board 21 and is soldered to a printed circuit 46 on the upper surface of the board 21. The other end 38 projects out of the housing. To permit such disposition of the leads 30, the extension 31 has a greater diameter than the outer diameter of the winding 17, and is provided with guide tabs 34 projecting outwardly, which fit in openings 33 formed in the baseplate 20, the hole 32 being formed in the guide tab 34. It is to be understood that the hole 32 firmly holds the leads 30 by friction, protecting the board 21 from shocks which may be applied and transmitted through the leads 30. It will be understood that the leads 30 may be secured to the extension 31 by means of adhesive 35. The guide tab 34 serves electrically insulating the leads 30 from the baseplate 20.

Figure 3:
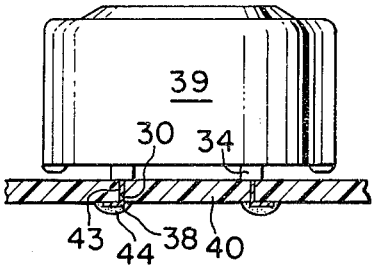
FIGS. 3 and 4 are side elevations illustrating the conditions under which the buzzer is used.
Figure 4:
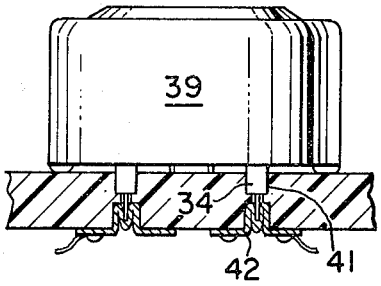

As will be evident by reference to FIGS. 3 and 4, a buzzer 39 having rigid electrical leads of the invention can be easily mounted on an external electrical circuit such as printed circuit board 40 in the similar manner as usual electrical components, or can be fitted into sockets 42 having openings 41. When the buzzer is mounted on the board 40, the board is provided with through-holes 43, into which the electrical leads 30 of the buzzer 39 are inserted. The guide tabs 34 maintain a proper spacing between the buzzer and board and the buzzer can be secured by folding the ends 38 of the leads 30 and soldering them to the board. When the buzzer is inserted into the sockets 42, the guide tabs 34 of the buzzer are fitted into the openings 41 and are frictionally retained therein.

The rigid leads 30 may be formed of a strip of copper or phosphor bronze, for example. When the buzzer is fitted into sockets having standard openings, connection pins capable of engaging such openings may be utilized.

When manufacturing the buzzer of the invention, the vibrator unit 5 is mounted in the housing 1 while the drive unit 15 is separately assembled. The assembly of the drive unit 15 takes place by mounting electrical components 22 and one end 36 of electrical leads 30 on the printed circuit board 21. Subsequently the board 21 is mounted on the upper flange 19 of bobbin 16 having winding 17 disposed thereon. The lead wires of winding 17 are electrically connected with the circuit on the board 21. The other end 38 of leads 30 is forced through openings 32 formed in the extension 31 of the lower flange 18. The assembly of the drive unit 15 is completed by mounting the coil assembly 14 with board 21 mounted thereon, on top of the baseplate 20. The buzzer of the invention is then completed by mounting the assembled drive unit 15 within the housing 1 in which the vibrator unit 5 is already mounted. As known, rivets which are integral with bobbin 16 may be utilized when mounting the baseplate 20 and board 21 on the respective flanges 18, 19 of bobbin 16.

Figure 5:
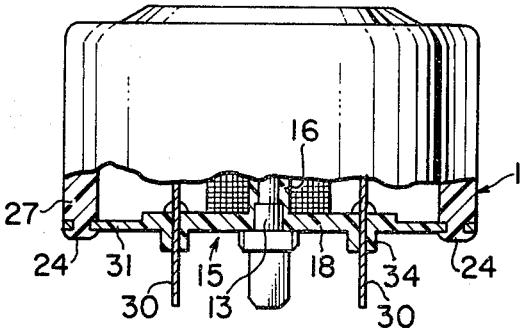
FIG. 5 is a side elevation, partly in section, of a modification of the buzzer shown in FIG. 1.

FIG. 5 shows a modification of the buzzer shown in FIG. 1. In this instance, the drive unit 15 does not include a baseplate, but instead the lower flange 18 of bobbin 16 has an extension 31 of an increased dimension such that the periphery of the extension 31 can be attached to the housing 1 by means of rivets 24. The use of a baseplate formed of a magnetic material improves the magnetic effect of the core 13 on the vibrating arm to a certain degree. However, the present modification is preferred to provide an inexpensive buzzer, provided such effect can be compromised.

FIG. 6 shows another buzzer of the invention which does not internally house an electronic oscillator circuit. A buzzer 50 is shown which is mounted on a printed circuit board 52, together with electrical components 51 of an external electrical circuit. The drive unit 15 within the buzzer 50 only comprises a coil assembly 14 including bobbin 16, the upper flange 19 of which has an extension 53 of an increased diameter than the diameter of winding 17, supporting the end 36 of rigid leads 30 which pass through the extension 31 of the lower flange 18. After passing through an opening 54 formed in the extension 53, the end 36 of the lead 30 is bent at right angles and then electrically connected with a lead wire 45 of winding 17. An oscillator current is supplied to the winding 17 from the electronic oscillator circuit formed on the board 52 through the leads 30.

FIG. 7 shows a buzzer including an electronic oscillator circuit which is formed by a flat package integrated circuit device. Both upper and lower flanges 18, 19 of the bobbin 16 include extensions 31, 53, with the upper extension 53 supporting the device 55. The device 55 is provided with a pair of rigid input leads 30, only one of which is shown in the drawing, and is also provided with a plurality of output terminals 56. The extension 53 is formed with an opening 57, across which the device 55 is supported in a suitable manner. Rigid leads 30 extending from the device 55 pass through holes 32 formed in the other extension 31 to project externally. The output terminals 56 of the device 55 are electrically connected with the winding 17. In the example shown, leads associated with the flat packaged integrated circuit device are utilized, but such leads are generally have a reduced mechanical strength, which can be compensated for by the provision of a leg 58 which extends from the baseplate 20 as shown. In this example, one end 59 of the core 13 is secured to the baseplate 20, and the bobbin 16 is held sandwiched between the core 13 and the baseplate 20.

Figure 9:
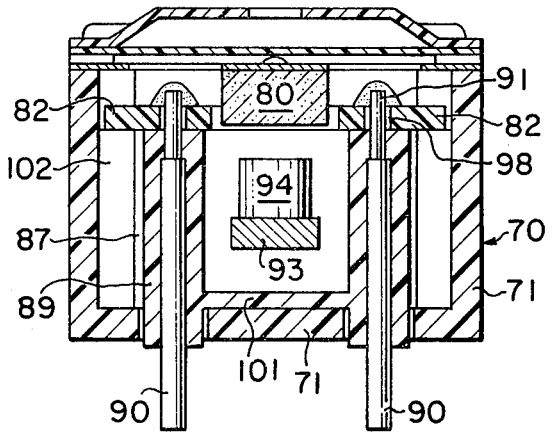
FIG. 9 is a cross section taken along the line 9—9 shown in FIG. 8.
Figure 10:
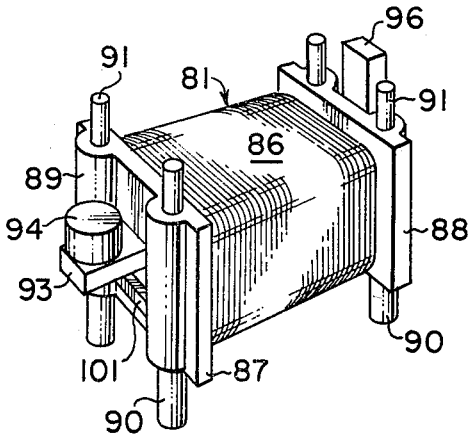
FIG. 10 is a perspective view of the drive unit shown in FIGS. 8 and 9.

FIGS. 8 to 10 show another embodiment of the invention in which the bobbin of the buzzer has an axis which is disposed parallel to a diaphragm. A cup-shaped housing 70 includes a sidewall 71 and a bottom 72. A vibrator unit 73 is fixedly mounted, together with a top plate 74 having an aperture 75, on the top end 69 of the sidewall by means of rivets 76. The vibrator 73 is similarly constructed as shown in FIG. 1. Specifically, it includes a diaphragm 77, a spacer ring 78 and a vibrating arm 79 carrying a permanent magnet 80 on its free end. A drive unit 83 including a coil assembly 81 and a printed circuit board 82 are housed within the housing 70.

The coil assembly 81 comprises a bobbin 84 having an axis which is parallel to the diaphragm 77 of the vibrator unit 73, an L-shaped core 85 extending through the bobbin 84, and a winding 86 disposed on the bobbin. At its opposite axial ends, bobbin 84 is provided with flanges 87, 88, which are formed with a plurality of ribs 89 extending in a direction perpendicular to the axis of bobbin 88. Each rib is hollow and firmly holds a rigid electrical lead 90 which extends therethrough. The upper end 91 of lead 90 passes through a through-hole 98 formed in the board 82 and is electrically connected with the circuit on the upper surface of the board. While four leads are shown in FIG. 10, it should be understood that the number of leads may be reduced to two. An integrated circuit device 92 which forms an electronic oscillator circuit which controls the winding 86 is mounted on the board 82. A solid cylindrical, magnetic pole member 94 is mounted on one end 93 of the core 85, and is located in opposing relationship with permanent magnet 80 on the free end of the vibrating arm 79 and which extends through an aperture 95 formed in the board 82. The other end 96 of the core 85 passes through another aperture 97 formed in the board 82 to be located opposite to the base end of the vibrating arm 79. In this manner, an effective magnetic circuit of a reduced reluctance is formed by the core 85 and vibrating arm 79.

In its bottom 72, the housing 70 is formed with a relatively large aperture 100 which receives part of coil assembly 81 when the drive unit 83 is loaded into the housing 70. The drive unit 83 is secured in position by engaging ribs 101 on the both flanges 87, 88 around the aperture 100 formed in the bottom 72 of housing 70 (see FIG. 8), and engaging a lateral edge of the board 82 with shoulders 102 formed on the sidewall 71 of housing 70 (see FIG. 9), the parts being adhesively secured together at the location of engagement.

In assembly, a pre-assembled drive unit 83 is mounted within the housing 70, and then the vibrator unit 73 and the top plate 74 fitted over rivets 76 on the top end of housing 70 while the rivets are still in straight form, and thereafter the rivets 76 are swaged under heat.

What is claimed is:

1. A buzzer with rigid electrical leads comprising a housing, a vibrator unit including a diaphragm which is supported by the housing, and a drive unit including a coil assembly which electromagnetically excites the vibrator unit, the coil assembly including a bobbin of a non-magnetic and non-conductive material and having a pair of flanges at its opposite axial ends, and a winding on the bobbin, the drive unit including a plurality of rigid electrical leads which project externally of the housing, and electrical circuit means for connecting the leads with the winding, at least one of the flanges having guide means which support the leads, said electrical leads serving to connect the winding electrically with an external electrical circuit and to mount the buzzer on an external mounting structure.

2. A buzzer according to claim 1 in which the coil assembly further includes a core disposed in axial alignment with the bobbin.

3. A buzzer with rigid electrical leads comprising a housing, a vibrator unit including a diaphragm which is supported within the housing, and a drive unit which electromagnetically excites the vibrator unit, the drive unit including a bobbin of a non-magnetic and nonconductive material and having an axis which is substantially perpendicular to the diaphragm and having a first and a second flange at its opposite axial ends, the bobbin being disposed such that the first flange is located nearer the vibrator unit than the second flange, the drive unit also including a winding disposed on the bobbin, a printed circuit board mounted by the first flange and carrying electrical components which cooperates with the winding to form an electronic oscillator circuit, and rigid electrical leads having their one end electrically connected with the printed circuit board and their other end extending through the second flange to project to the outside of the housing.

4. A buzzer according to claim 3 in which the housing includes a baseplate of a magnetic material, to which the bobbin is mounted by means of its second flange, the second flange having an extension which extends to the outside of the winding, the extension including guide means having openings which communicate with the opposite side of the baseplate, the electrical leads passing through the openings in a direction parallel to the axis of the bobbin.

5. A buzzer according to claim 4 in which guide means is in the form of columns projecting to the opposite side of the baseplate.

6. A buzzer according to claim 3 in which the housing has an open end and in which the second flange has an extension of a size extending to the outside of the winding, the bobbin being mounted in the housing by mounting the extension on the open end of the housing, the extension being formed with openings through which the electrical leads extend in a direction parallel to the axis of the bobbin.

7. A buzzer with rigid electrical leads comprising a housing, a vibrator unit including a diaphragm which is supported within the housing, and a drive unit which electromagnetically excites the vibrator unit, the drive unit including a bobbin of a non-magnetic and non-conductive material and having an axis which is substantially perpendicular to the diaphragm and having a first and a second flange at its opposite axial ends, the bobbin being disposed such that the first flange is located nearer the vibrator unit than the second flange, the drive unit also including a winding disposed on the bobbin, a plurality of rigid electrical leads having their one end engaged with the first flange and their other end extending through the second flange to project to the outside of the housing, and means for connecting one end of the leads with the winding electrically.

8. A buzzer according to claim 7 in which each of the first and second flanges includes an extension of a size which extends to the outside of a winding, each extension being formed with openings through both of which the electrical leads extend in a direction parallel to the axis of the bobbin.

9. A buzzer according to claim 7 in which said connecting means comprise lead wires.

10. A buzzer with rigid electrical leads comprising a housing, a vibrator unit including a diaphragm which is supported within the housing, and a drive unit which electromagnetically excites the vibrator unit, the drive unit including a bobbin of a non-magnetic and non-conductive material and having an axis which is substantially perpendicular to the diaphragm and having a first and a second flange at its opposite axial ends, the bobbin being disposed such that the first flange is located nearer the vibrator unit than the second flange, the drive unit also including a winding disposed on the bobbin, a plurality of rigid electrical leads having their one end engaged with the first flange and their other end passing through the second flange to project to the outside of the housing, and lead wires for electrically connecting the winding with one end of the leads, and an external printed circuit board having a circuit which is electrically connected with the other end of the leads and carrying an electronic oscillator circuit thereon which energizes the winding.

11. A buzzer with rigid electrical leads comprising a housing, a vibrator unit including a diaphragm which is supported within the housing, and a drive unit which electromagnetically excites the vibrator unit, the drive unit including a bobbin of a non-magnetic and non-conductive material and having an axis which is substantially perpendicular to the diaphragm and having a first and a second flange at its opposite axial ends, the bobbin being disposed such that the first flange is located nearer the vibrator unit than the second flange, the drive unit also including a winding disposed on the bobbin, an integrated circuit device supported by the first flange and forming an electronic oscillator circuit which energizes the winding, and a plurality of rigid electrical leads having their one end electrically connected with the integrated circuit device and their other end passing through the second flange to project to the outside of the housing.

12. A buzzer with rigid electrical leads comprising a housing, a vibrator unit including a diaphragm which is disposed within the housing, and a drive unit within the housing for electromagnetically exciting the vibrator unit, the drive unit including a bobbin of a non-magnetic and non-conductive material and having an axis which is substantially parallel to the diaphragm and having a pair of flanges at its opposite axial ends, a winding on the bobbin, a core disposed in axial alignment with the bobbin and having its one end projecting from one of the flanges and forming a magnetic pole which is spaced from and opposes the vibrator unit, a plurality of rigid electrical leads supported by a selected one of the flanges and having their one end located within the housing and their other end projecting externally of the housing, the leads extending in a direction substantially perpendicular to the diaphragm and being disposed in a vertical plane which is parallel to a vertical plane including the axis of the bobbin, and means for electrically connecting the winding with one end of the leads.

13. A buzzer according to claim 12 in which the other end of the core extends through the other flange and then folded to be located opposite to and spaced from the vibrator unit, thereby forming a magnetic circuit of a reduced reluctance between the core and the vibrator unit.

14. A buzzer according to claim 12 in which the selected flange has raised portions including an extension on the outer surface of the flange which projects out of the housing, each of the raised portions having a through-hole therein, the leads being received in the through-holes.

15. A buzzer according to claim 12 in which the connecting means includes a printed circuit board extending across the flanges and on which electrical components are provided which cooperates with the winding to form an electronic oscillator circuit.

16. A buzzer according to claim 1, 3, 7, 10, 11 or 12 in which the vibrator unit further includes a cantilever vibrating arm which impacts the diaphragm, the drive unit electromagnetically exciting the vibrating arm.

* * * * *